US009279551B2

(12) United States Patent
Vissenberg et al.

(10) Patent No.: US 9,279,551 B2
(45) Date of Patent: Mar. 8, 2016

(54) LIGHTING SYSTEM

(71) Applicant: KONINKLIJKE PHILIPS N.V., Eindhoven (NL)

(72) Inventors: Michel Cornelis Josephus Marie Vissenberg, Roermond (NL); Johannes Andreas Henricus Maria Jacobs, Veldhoven (NL); Ramon Pascal van Gorkom, Eindhoven (NL); Mark Johannes Antonius Verhoeven, Deurne (NL); Andreas Aloysius Henricus Duijmelink, Helmond (NL); Huib Cooijmans, Son en Breugel (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/362,146

(22) PCT Filed: Nov. 29, 2012

(86) PCT No.: PCT/IB2012/056832

§ 371 (c)(1),
(2) Date: Jun. 2, 2014

(87) PCT Pub. No.: WO2013/084119

PCT Pub. Date: Jun. 13, 2013

(65) Prior Publication Data

US 2014/0355267 A1 Dec. 4, 2014

Related U.S. Application Data

(60) Provisional application No. 61/566,754, filed on Dec. 5, 2011.

(51) Int. Cl.
*F21V 23/02* (2006.01)
*F21S 4/00* (2006.01)

(Continued)

(52) U.S. Cl.
CPC ..... *F21S 4/001* (2013.01); *F21S 2/005* (2013.01); *F21S 4/00* (2013.01); *F21V 23/02* (2013.01);

(Continued)

(58) Field of Classification Search
None
See application file for complete search history.

(56) References Cited

U.S. PATENT DOCUMENTS 6,788,541 B1 9/2004 Hsiung
8,111,022 B2 * 2/2012 Snijder et al. ..... 315/312

(Continued)

FOREIGN PATENT DOCUMENTS

DE 202007011884 U1 10/2007
JP 2011-187973 * 9/2011

(Continued)

*Primary Examiner* — Ashok Patel
(74) *Attorney, Agent, or Firm* — Meenakshy Chakravorty

(57) ABSTRACT

A lighting system comprises a plurality of discrete light emitting diode modules and a translucent portion containing the plurality of discrete light emitting diode modules. Each light emitting diode module comprises a light emitting diode and at least a first module electrode and a second module electrode. The first module electrode is in electrical connection with the cathode of the light emitting diode and the second module electrode is in electrical connection with the anode of the light emitting diode. At least a portion of the plurality of light emitting diode modules form a string of modules, with at least one module electrode of each of the light emitting diode modules in the string being in direct physical contact with a module electrode of a neighboring light emitting diode module in the string such that, when a voltage is applied across the string, current flows in each light emitting diode module in the string thereby activating the light emitting diode of each light emitting diode module in the string.

12 Claims, 10 Drawing Sheets

(51) Int. Cl.

| | |
|---|---|
| ***F21V 31/00*** | (2006.01) |
| ***F21S 2/00*** | (2006.01) |
| ***F21V 23/06*** | (2006.01) |
| *F21V 33/00* | (2006.01) |
| *F21S 10/02* | (2006.01) |
| *F21W 121/00* | (2006.01) |
| *F21W 131/301* | (2006.01) |
| *F21Y 101/02* | (2006.01) |

(52) U.S. Cl.

CPC ..... *F21V 23/06* (2013.01); *F21V 31/005* (2013.01); *F21S 10/02* (2013.01); *F21V 33/006* (2013.01); *F21V 33/0012* (2013.01); *F21W 2121/00* (2013.01); *F21W 2131/301* (2013.01); *F21Y 2101/02* (2013.01)

(56) References Cited

U.S. PATENT DOCUMENTS

| | | | | |
|---|---|---|---|---|
| 8,310,175 | B2 * | 11/2012 | Van Endert | 315/318 |
| 2004/0251818 | A1 * | 12/2004 | Duggal et al. | 313/504 |
| 2005/0214963 | A1 | 9/2005 | Daniels et al. | |
| 2006/0202333 | A1 | 9/2006 | Sun et al. | |
| 2006/0238365 | A1 | 10/2006 | Vecchione et al. | |
| 2006/0256584 | A1 * | 11/2006 | Paoluccio | 362/652 |
| 2007/0091614 | A1 | 4/2007 | Kaisser et al. | |
| 2008/0111470 | A1 | 5/2008 | Yuan et al. | |
| 2008/0299841 | A1 | 12/2008 | Panella et al. | |
| 2010/0019253 | A1 | 1/2010 | Kim et al. | |
| 2010/0190227 | A1 | 7/2010 | Dauth et al. | |
| 2010/0197148 | A1 | 8/2010 | Rudisill et al. | |
| 2010/0220470 | A1 | 9/2010 | Kim | |
| 2010/0259108 | A1 | 10/2010 | Giler et al. | |
| 2012/0057349 | A1 * | 3/2012 | Loraing | 362/249.02 |

FOREIGN PATENT DOCUMENTS

| | | | |
|---|---|---|---|
| WO | 2008005557 | A2 | 1/2008 |
| WO | 2009079209 | A1 | 6/2009 |
| WO | 2009101561 | A1 | 8/2009 |
| WO | 2011099288 | A1 | 8/2011 |

* cited by examiner

LIGHTING SYSTEM

CROSS-REFERENCE TO PRIOR APPLICATIONS

This application is the U.S. National Phase application under 35 U.S.C. §371 of International Application No. PCT/IB2012/056832, filed on Nov. 29, 2012, which claims the benefit of [e.g., U.S. Provisional Patent Application No. or European Patent Application No.] 61/566,754, filed on Dec. 5, 2011. These applications are hereby incorporated by reference herein.

FIELD OF THE INVENTION

The invention relates to a lighting system. Specifically, the invention relates to a lighting system comprising light emitting diodes.

BACKGROUND OF THE INVENTION

The availability of light emitting diodes (LEDs) that are suitable for general illumination purposes allows for the use of LED light sources in many different scenarios. Designers all over the world are currently investigating new designs that are made possible by the small form factor and low-voltage driving of LEDs. These features enable easy integration of LED light sources in the interior (ceilings, walls, carpet), into furniture or tools, or even embedding into materials like plastics, glass, silicone and concrete.

An important limitation for embedding LEDs into a material is that they require power. Usually, the power is supplied by a fixed wire or a fixed wire grid. This is a flexible solution, but it requires a redesign of the wiring structure for each new object shape, which increases the cost and the time-to-market. There is therefore a need for a solution to these problems.

SUMMARY OF THE INVENTION

In a first example of the present invention, a lighting system is provided. The lighting system comprises a plurality of discrete light emitting diode modules and a translucent portion containing the plurality of discrete light emitting diode modules. Each light emitting diode module comprises a light emitting diode and at least a first module electrode and a second module electrode. The first module electrode is in electrical connection with the cathode of the light emitting diode and the second module electrode is in electrical connection with the anode of the light emitting diode. At least a portion of the plurality of light emitting diode modules form a string of modules, with at least one module electrode of each of the light emitting diode modules in the string being in direct physical contact with a light emitting diode module electrode of a neighboring light emitting diode module in the string such that, when a voltage is applied across the string, current flows in each light emitting diode module in the string thereby activating the light emitting diode of each light emitting diode module in the string. The lighting system can take many different shapes or forms without requiring the provision of a bespoke, or indeed any, wiring system connecting the light emitting diode modules. Consequently, designers have more freedom to make lighting systems of many different shapes without also needing to consider the design of specific wiring patterns to suit each different system.

The plurality of discrete light emitting diode modules may be irregularly distributed within the translucent portion. As such, the LED modules need not be specifically arranged within the system. This reduces both the time and cost associated with creating a lighting system.

In a second example of the present invention, a light emitting diode module is provided. The light emitting diode module is for use in the lighting system of the first example. The light emitting diode module comprises a light emitting diode and at least a first module electrode and a second module electrode. The first module electrode is in electrical connection with the cathode of the light emitting diode and the second module electrode is in electrical connection with the anode of the light emitting diode. The light emitting diode module is configured such that, when one of the first and second module electrodes is in direct physical contact with a module electrode of a neighboring, identical light emitting diode module and when a voltage is applied across the light emitting diode module and the neighboring light emitting diode module, current flows in the light emitting diode module thereby activating the light emitting diode.

In the first and second examples, the first and second module electrodes may be provided on opposing sides of a volume of the light emitting diode module such that an axis extending between the first and second module electrodes passes through a central point of the volume. This facilitates the formation of conductive paths throughout the lighting system.

The light emitting diode module of the second example or each light emitting diode module of the first example may comprise a body, at least a portion of which is translucent, the light emitting diode being encased within the translucent portion of the body such that light emitted by the light emitting diode is detectable outside the body. Each of the first and second module electrodes of each light emitting diode module may comprise a surface electrode provided on an exterior surface of the body.

The or each light emitting diode module may be configured such that the light emitting diode or a second light emitting diode is activated when a voltage difference is provided across the first and second module electrodes, regardless of the polarity of the voltage. As such, the light emitting diode modules may not need to be specifically orientated within the system in order to allow the formation of conductive paths. This may be achieved by providing the or each light emitting diode module with the light emitting diode and the second light emitting diode, the cathode of the light emitting diode and the anode of the second light emitting diode being electrically connected with the first module electrode, and the cathode of the second light emitting diode and the anode of the light emitting diode being electrically connected with the second module electrode. Alternatively, the or each light emitting diode module may comprise a bridge rectifier circuit electrically connected with the light emitting diode such that the light emitting diode is activated regardless of the polarity of the voltage difference provided across the first and second module electrodes. In another alternative, the or each light emitting diode module may comprise an integrated circuit configured to determine the polarity of the voltage difference provided across the first and second module electrodes and to route current from the module electrode having the higher voltage to the cathode of the light emitting diode.

The or each light emitting diode module may comprise a third module electrode and a fourth module electrode, the third module electrode being in electrical connection with the cathode of the light emitting diode and the fourth module electrode being in electrical connection with the anode of the light emitting diode, or the third module electrode being in electrical connection with the cathode of another light emitting diode and the fourth module electrode being in electrical connection with the anode of the another light emitting diode. The provision of plural pairs of electrodes allows a large total area of electrodes to be provided but also enables the reduction of short-circuits.

The module electrodes of the or each light emitting diode module may comprise planar surface electrodes. This facilitates stacking of the modules within the system and so, in turn, facilitates the transfer of electrical power throughout a string of modules.

One of the module electrodes of the or each light emitting diode module may be concavely-shaped and the other module electrode of the or each light emitting diode module may be convexly-shaped. This facilitates the formation of good direct physical connections between neighboring modules and so also facilitates the transfer of electrical power throughout a string of modules.

The or each light emitting diode module may comprise a magnetic dipole that is substantially aligned with an axis that extends between the first and second module electrodes. This encourages electrodes of neighboring modules to align with one another and also provides a good physical connection between the electrodes. As such, this feature also facilitates the transfer of electrical power throughout a string of modules.

The lighting system may comprise at least two terminal modules that are in direct physical contact with the light emitting diode modules at opposite ends of the string. The terminal modules comprise a module electrode, which is in physical contact with a module electrode of the light emitting diode module, and a power transfer element for receiving electrical power from, or transferring electrical power to, a power source. In this way, power for causing illumination of the modules in strings between the at least two terminal modules may be provided.

In some examples, the module electrodes of the light emitting diode module of the second example, or of each light emitting diode module of the first example, may include a layer of insulating material provided thereon. In such examples, light emitting diode modules in direct, physical contact capacitively couple with one another. The or each light emitting diode module may include an inductor, for tuning the resonant frequency of the or each module. If a power supply that provides electric energy to the modules that are in direct, physical contact is driven at the resonant frequency of the modules, the efficiency of the system is increased. In alternative examples, an inductor may be connected in series with a power supply.

The translucent portion may comprise an insulating filling material in which the plurality of light emitting diode modules is embedded. The aggregate of the volumes of all the modules may constitute over 25% of the volume of the lighting system. The insulating filling material may constitute substantially the remainder of the volume of the lighting system. The volume of each module may be defined as the volume between the module electrodes in which the light emitting diode is located. The aggregate of the volumes of all the modules may constitute between 30% and 40% of the volume of the lighting system. A percentage in excess of 25% and optionally between 30% and 40% allows strings of modules to form throughout the lighting system.

BRIEF DESCRIPTION OF THE DRAWINGS

For a more complete understanding of embodiments of the present invention, reference is now made to the following description taken in connection with the accompanying drawings in which.

DETAILED DESCRIPTION

Figure 1B:
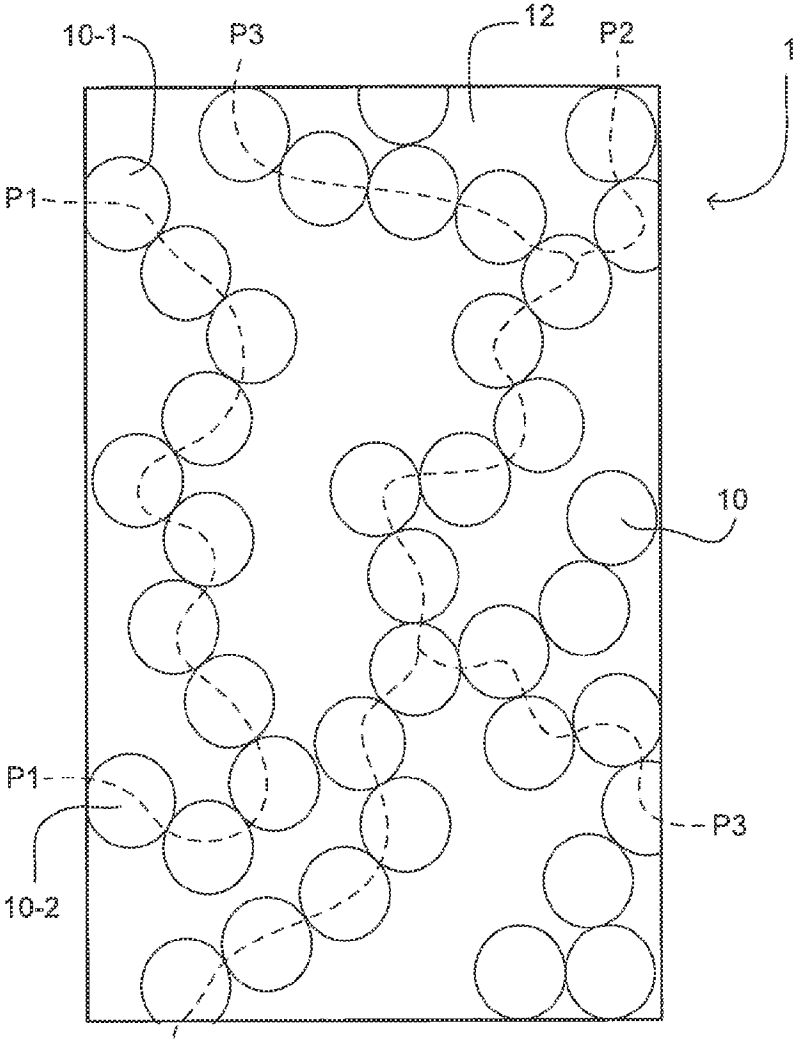
FIGS. 1A and 1B are schematics illustrating an aspect of the invention.

In the description and drawings, like reference numerals refer to like surface electrodes throughout.

Figure 1A:
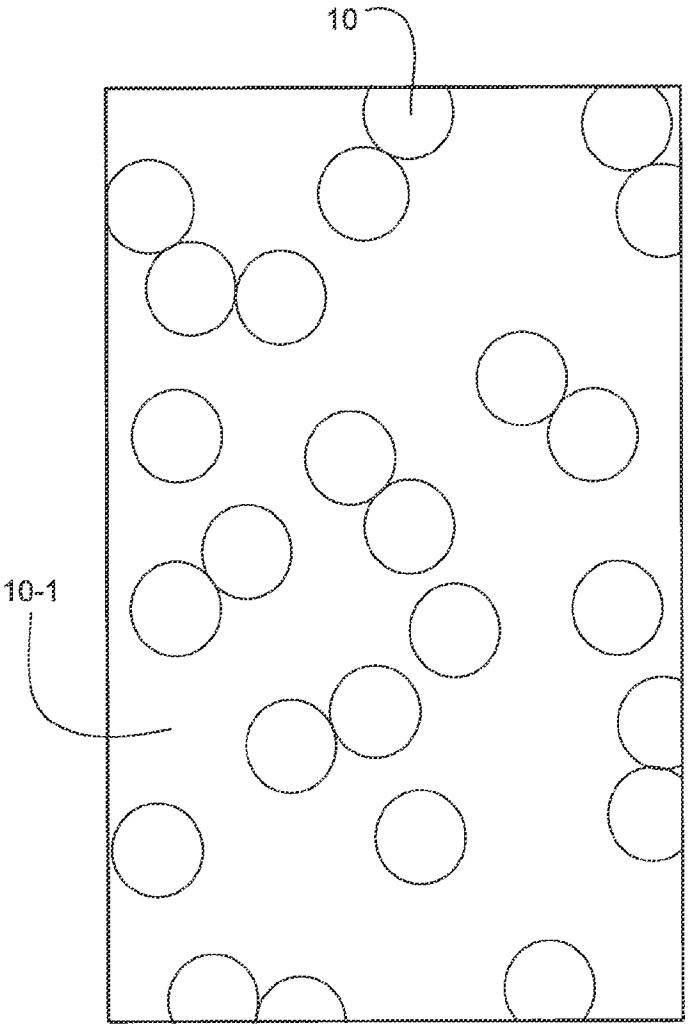

FIGS. 1A and 1B illustrate how the invention makes use of the physical effect known as "percolation". Specifically, the invention makes use of percolation of electric energy along randomly-formed conductive paths in an insulating filler material.

FIG. 1A shows a composite material including a relatively low number of discrete light emitting diode (LED) modules 10 distributed within an insulating filler (or bulk) material 12.

Although not visible in FIG. 1A, each of the LED modules 10 comprises at least one LED and first and second module electrodes. The module electrodes are comprised of an electrically conductive material. Each of the first and second module electrodes is in electrical connection with at least one of the anode and cathode of the LED. Each LED module 10 is operable to receive electrical current from, and to pass electric current to, a neighboring LED module 10. Two LED modules 10 are neighbors if a module electrode of the first module is in direct physical contact with a module electrode of the second LED module. The physical contact between the module electrodes of two neighboring modules is direct in that there is no intervening material, such as a conjoining wire, between the module electrodes. The LED modules 10 are discrete in the sense that, before being mixed with the insulating filler material 12 to form the composite material, they are separate, or separable, from one another.

In the composite material of FIG. 1A, the number of LED modules 10 per unit volume of composite material is too low. As such, each module, or group of neighboring modules, is isolated from other modules by the insulating material. As such, it is not possible for electric energy to pass between modules 10 of different groups. In other words, percolation of electric energy throughout the composite material 1 of FIG. 1A is not possible.

However, when the number of LED modules 10 per unit volume of composite material reaches a threshold, known as the "percolation threshold", the whole volume of the composite material 1 is spanned with a network of randomly-formed paths along which electric energy is able to propagate. These conductive paths are made up by strings of neighboring LED modules 10, with electric energy being passed from one module 10 to its neighbor.

A part of a lighting system 1 in accordance with the invention is shown in FIG. 1B. In the lighting system 1, the percolation threshold has been surpassed and so a plurality of different strings of LED modules 10 have been formed throughout the volume of the composite material. As a result of the formation of these strings, which allow propagation of electrical energy and, therefore the activation of LEDs in the strings, the composite material can now operate as a lighting system 1. Three of these strings are denoted by the dotted lines labeled P1 to P3. As can be seen from strings P2 and P3, some LED modules 10 may be members of plural different strings. The percolation threshold usually occurs when the aggregate volume of the LED modules 10 constitutes 25-50% of the volume of the system 1. More commonly, the percolation threshold falls within the range of 30-40%.

Current is unable to pass through the insulating filter material 12. The insulating filler material 12 is translucent such that light is able to pass through it. In this specification, translucency is to be understood as including transparency.

The insulating filler material 12 may comprise a solid. The insulating filler material 12 may comprise a thermo-setting, or an otherwise hardening or setting, material. The insulating filler material 12 may comprise, for example, glass, a resin, silicone, a plastic such as poly(methyl methacrylate) (PMMA), polycarbonate (PC) or polyethylene terephthalate (PET). The material 12 may alternatively be an insulating material having a relatively low translucency, such as gypsum (plaster) or paper with transparent glue (papier-mâché). In these examples, the insulating filler material may be referred to as a module-containing portion of the lighting system 1 in that it contains the modules.

The composite material of which the lighting system 1 is comprised may contain additional materials to obtain a specific light effect. For example, Titanium Oxide particles may be included to tune the degree of transparency (specifically, a higher density of titanium oxide results in more scattering and so less transparency). Similarly, pigments may be included to obtain a certain color, or colored or reflective flakes or beads may be included to provide a sparkling effect.

The composite material of which the lighting system 1 of FIG. 1B is comprised may be created by mixing the discrete LED modules 10 with the translucent insulating filler material 12. Subsequently, the material can be moulded and set into any desired shape to form the lighting system 1. If a power source is connected across the LED modules 10 at distal ends of one or more strings (such as the modules labeled 10-1 and 10-2 which are at the distal ends of the string labeled P1), the modules 10 within the string(s) are activated (i.e. are caused to emit light). As the insulating filler material 12 is translucent, the lighting system as a whole emits light.

In alternative examples, the filler material 12 may be a fluid (for example oil, silicone oil or silicone grease) or a gas (for example air) inside a translucent shell or container. This allows for a dynamic formation of paths, which results in dynamic conductive paths, which can be changed by shaking the container or shell, or by gravity over time. In these examples, the container or shell may be referred to as the module-containing portion.

In some examples the lighting system 1 may include conductive particles other than the LED modules, such that the combined volumes of the LED modules 10 and the other conductive particles is above the percolation threshold. This allows the number of LED modules 10 to be reduced, while at the same time maintaining conductive paths through the system 1.

FIG. 2 illustrates a first example of one of the LED modules shown in FIGS. 1A and 1B.

The module 10A of FIG. 1A comprises a module body 14, at least one LED 16, and a pair of module electrodes 18-1, 18-2.

In this example, the body 14 is substantially spherical. It will however, be appreciated from the later description that module bodies having other shapes may instead be used. The at least one LED 16 is encased within the body 14. At least a portion of the module body 14 is translucent such that the light emitted by the LED 16 is visible outside the module 10A. The module body 14 may be comprised of a moulded insulating material. Suitable materials include glass, plastics such as PMMA, PC, PET, PVC, transparent ceramics such as Alumina, or a gas such as air with a plastic, glass or ceramic shell In some examples, the body 14 may be made of two solid or hollow Alumina half-spheres. The module electrodes 18 may be formed of metal patterns deposited on the surface of the half-spheres. Alumina is advantageous in that it is very robust and also thermally conductive.

The pair of module electrodes 18-1, 18-2 is provided on the external surface of the module body 14. In this example, the module electrodes 18-1, 18-2 are surface electrodes. In other words, each of the module electrodes 18-1, 18-2 defines a surface having an area. Each of the module electrodes 18-1, 18-2 is provided on a different, separate portion of the exterior surface of the module body 14. Put another way, the module electrodes 18-1, 18-2 coat, or cover, different portions of the surface of the module body 14. The module electrodes 18-1, 18-2 may comprise any suitable conductive material, including but not limited to, copper, silver, gold, tin, aluminum, conductive ceramics, carbon, nickel, titanium, brass or other alloys or composites. The module electrodes 18-1, 18-2 may be transparent and may comprise thin layers or meshes of, for example, copper, silver and gold or a layer of, for example, Indium Titanium Oxide (ITO).

Figure 2A:
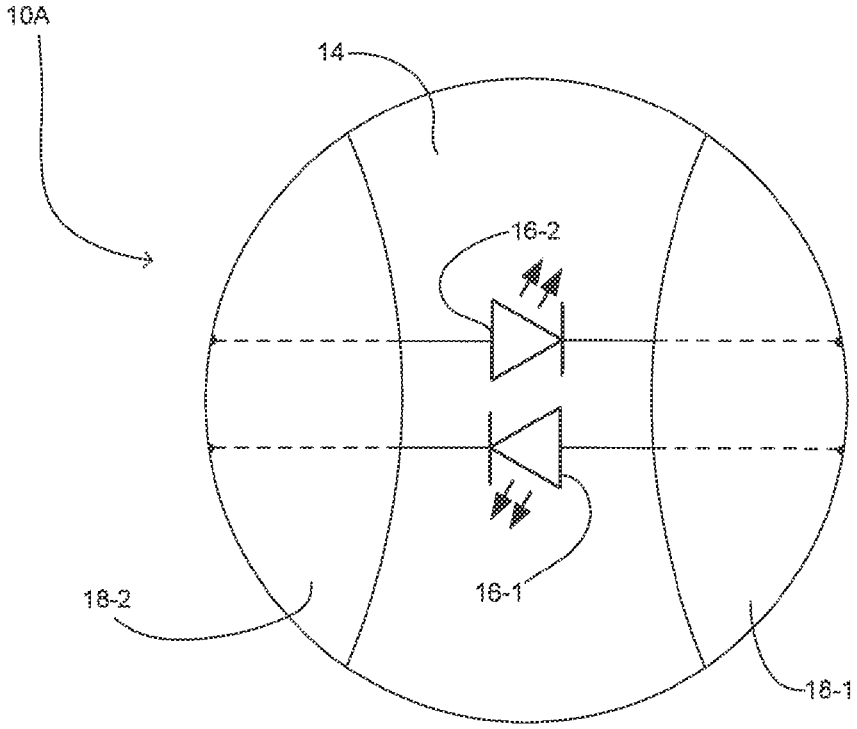
FIGS. 2A and 2B are schematic illustrations of LED modules in accordance with the invention.

Each of the pair of module electrodes 18-1, 18-2 is provided on a different opposing side of a volume of the module 10A, such that an axis extending from one module 18-1 to the other 18-2 passes through, or proximate to, a central point of the volume of the module. In the example of FIG. 2A (and indeed the other modules 10 illustrated in the Figures), the volume of the module 10A is delimited by the electrodes 18-1, 18-2 and the module body 14. However, in some example modules which do not include a module body, the volume of the module 10 may be delimited by the module electrodes and the LEDs, with the LEDs always being within the volume of the module.

In the module 10A of FIG. 2A (and in many of the other modules depicted in the Figures), the module electrodes 18-1, 18-2 are of the same size. Each of the module electrodes 18-1, 18-2 may cover up to slightly less than half of the area of the exterior surface of the module body 14. The module electrodes 18-1, 18-2 are distinct from one another such that current cannot pass from one electrode 18-1 to the other 18-2 without travelling through the interior of the module body 14.

The at least one LED 16 is arranged within the module 10A such that the cathode of the LED 16, is electrically connected with one of the module electrodes e.g. 18-1 and such that the anode of the LED 16 is electrically connected with the second of the pair of module electrodes e.g. 18-2. Consequently, when a voltage is applied across the first and second module electrodes 18-1, 18-2 current is able to travel through the LED 16 in a direction from the first module electrode 18-1 to the second module electrode 18-2.

In the example of FIG. 2A, the module 10A comprises a plurality (in this example, two) of LEDs 16-1, 16-2. The LEDs 16-1, 16-2 are provided in an anti-parallel arrangement. As such, a first of the module electrodes 18-1 is connected to the cathode of a first of the LEDs 16-1 and the anode of a second of the LEDs 16-2. The second module electrode 18-2 is connected to the anode of the first LED 16-1 and the cathode of the second LED 16-2. This arrangement means that one of the LEDs 16-1, 16-2 is activated regardless of the direction of the current through the module 10A.

Where a plurality of LEDs 16 are provided within a module 10, these may be provided on separate LED packages, or instead may be provided in a single LED package that contains anti-parallel connected die-segments.

The module 10 may be of any suitable size. For example, the volume of the module 10 may be approximately 1 $cm^3$. The volume of the modules 10 dictates, to an extent, the number of modules that is needed in order to create conductive paths through a volume of lighting system 1. As mentioned above, in general, 30-40% of the volume of the composite material, of which the system 1 is comprised, should be comprised of LED modules 10. Using larger modules 10 allows the number of modules 10 to be reduced and thereby also reduces the cost associated with producing the lighting system 1. However, the module size also dictates minimum dimensions for parts of the lighting system 1 moulded from the composite material. In other words, if smaller modules are used, narrower mouldings are possible. In some cases, it may be preferable to utilize modules 10 of various different sizes. In this way, the number of modules 10 required can be kept relatively low by using larger modules 10 for large features of the lighting system 1 while, at the same time, smaller more delicate features are also made possible by using modules 10 of a smaller size.

The examples of the various LED modules 10 that are described hereafter, include many similar features to the LED modules 10A described with reference to FIG. 2A. These similarities will be understood by the skilled person from the following description and the accompanying drawings but may not be explicitly stated. However, the differences, where relevant, will be described.

Figure 2B:
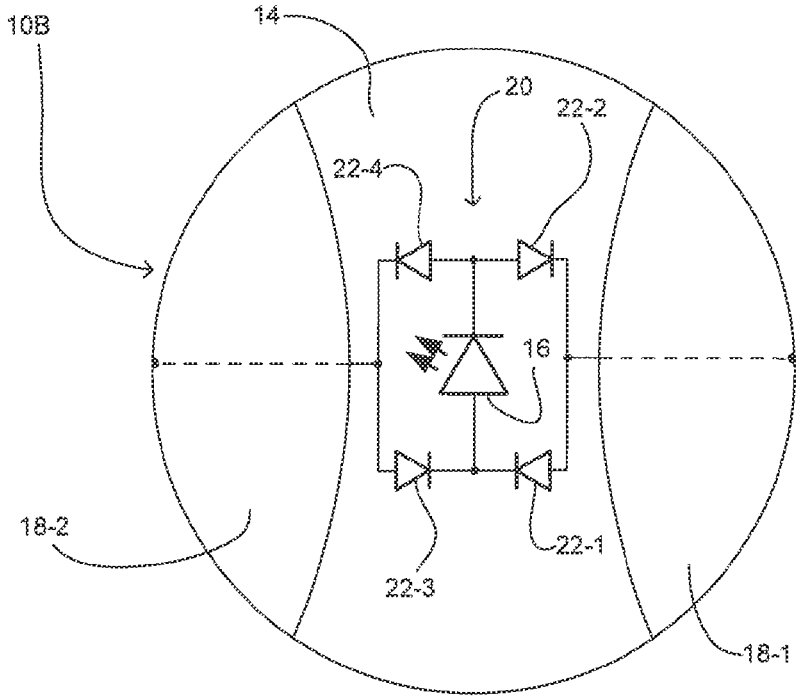

The effect of providing illumination regardless of the direction of current flow through the module 10 may also be accomplished by providing a bridge rectifier 20, in conjunction an LED 16, within the module 10B. This can be seen in FIG. 2B. In the example of FIG. 2B, the bridge rectifier 20 is comprised of standard diodes. However, LEDs, or a combination of standard diodes and LEDs may alternatively be used.

In this example, the cathode of a first of the diodes 22-1 and the anode of the second of the diodes 22-2 of the bridge rectifier 20 are electrically connected with the first module electrode 18-1. The cathode of a third of the diodes 22-3 and the anode of the fourth of the diodes 22-4 are electrically connected with the second module electrode 18-2. The anodes of the first and third diodes 22-1, 22-3 are connected to the cathode of the LED 16 and the cathodes of the second and fourth diodes 22-2, 22-4 of the bridge rectifier 20 are electrically connected with the anode of the LED 16. In this way, any current received at either of the first and second module electrodes 18-1, 18-2 is forced to travel to the cathode of the LED 16. As such, the LED 16 is activated regardless of the direction of current flow through the module 10B.

The diodes 22 of which the bridge rectifier 20 is comprised may be discrete components, may alternatively be integrated on a single piece of silicon having plural terminals, or may be integrated with the package in which the LED 16 is provided.

As the skilled person will appreciate, benefits are derived from the module electrodes 18 being as large as possible. Specifically, increasing the surface area of the module electrodes 18 increases the probability that, when two different modules 10 come into physical contact, a module electrode 18 of one of the modules will be in direct physical contact with a module electrode 18 of the neighboring module 10. However, this also increases the probability that module electrodes 18 of two different modules 10 will come into direct physical contact with the same module 18 electrode of a third module. In this situation, instead of flowing through the third module, the current may flow from the first module through only the module electrode of the third module to the second module. As such, the LED of the third module may not be activated. This situation is hereafter referred to as a short-circuit, and may not be desirable.

It will be thus be understood that the size of the module electrodes 18 may ideally be selected so as to maximize, as far as possible, the probability that module electrodes of two neighboring modules will be in contact, while at the same time minimizing, as far as possible, the probability that short circuits will occur.

It is possible to increase the overall area of the electrodes 18 of a module while at the same time keeping the probability of short circuit to an acceptable level by providing a plurality of pairs of module electrodes 18. This can be seen in FIG. 3A, in which the module 10C comprises two pairs of module electrodes 18-1A, 18-2A and 18-1B, 18-2B. In this example, the module comprises two bridge rectifiers 20-1, 20-2 in conjunction with a single LED 16. As such, regardless of the polarity of the module electrodes, current is always forced to the cathode of the light-emitting diode.

Figure 3A:
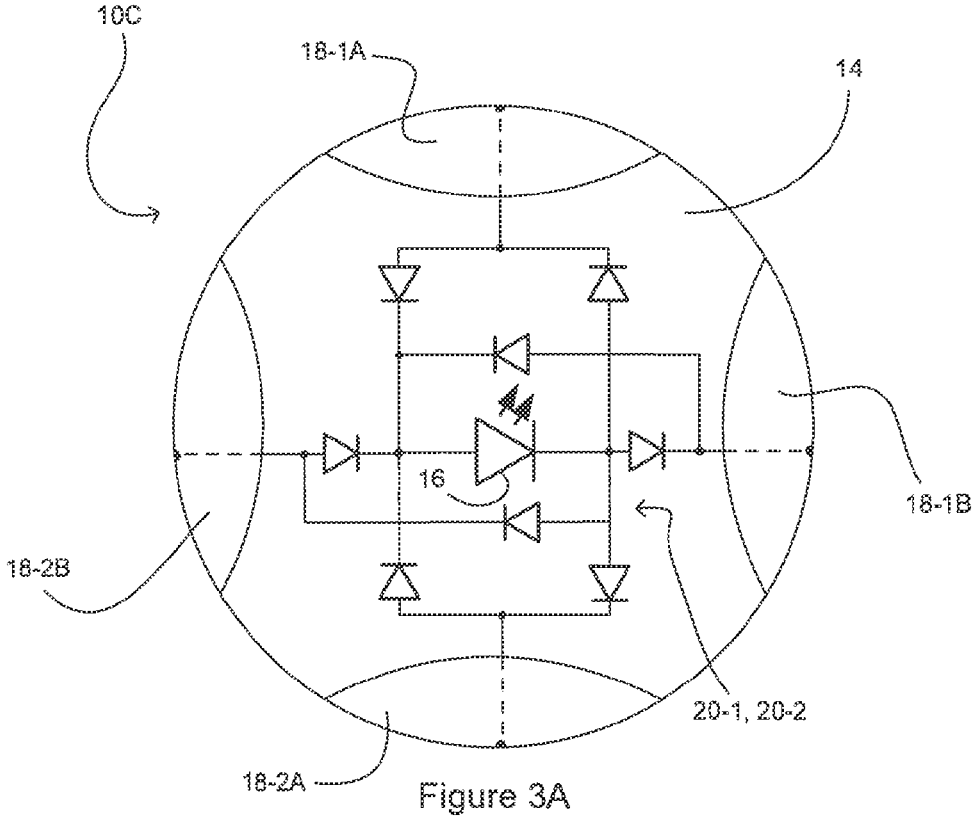
FIGS. 3A to 3C depict other examples of LED modules in accordance with the invention.
Figure 3B:
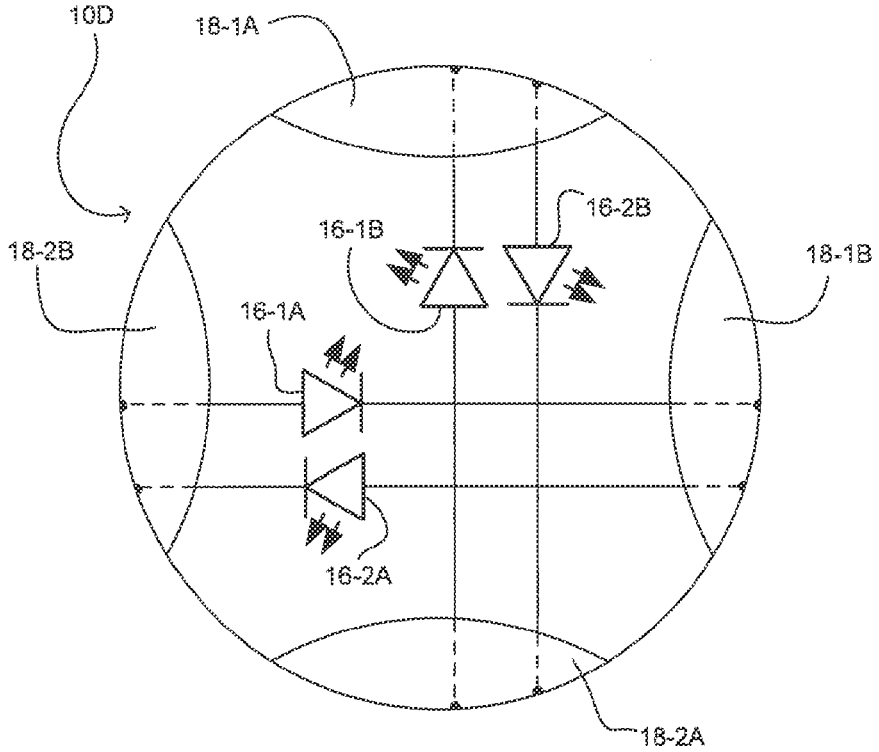

FIG. 3B illustrates an alternative example of a module 10D having a plurality of pairs of module electrodes 18-1A, 18-2A and 18-1B, 18-2B. In this example, each pair 18-1A, 18-2A and 18-1B, 18-2B is in electrical connection with an anti-parallel pair of LEDs 16-1A, 16-2A and 16-1B, 16-2B.

Figure 3C:
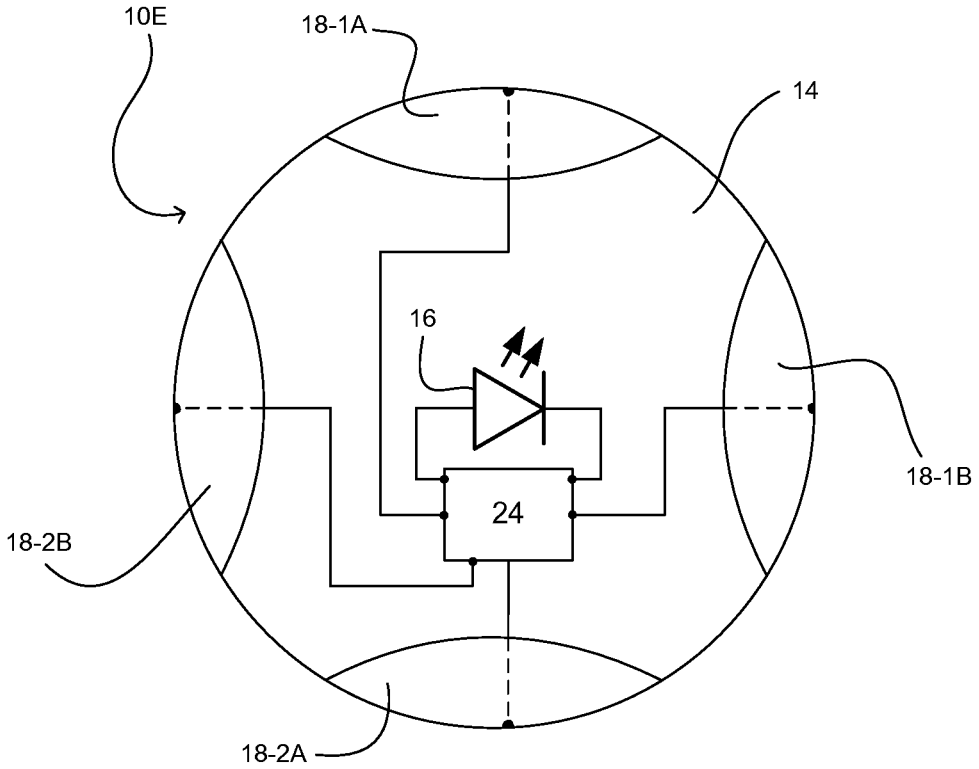

FIG. 3C depicts another alternative example of a module 10E including plural pairs of module electrodes 18-1A, 18-2A and 18-1B, 18-2B. In this example, the module 10E comprises an integrated circuit 24 and a single LED 16. The anode and the cathode of the LED 16 are connected to the integrated circuit, as are each of the module electrodes 18-1A, 18-2A and 18-1B, 18-2B. The integrated circuit 24 is operable to route all current through the LED 16 in a direction from the module electrode 18 having the highest voltage to the module electrode having the lowest voltage (i.e. one of the module electrodes 18 that is in contact with a neighboring module 10E). The provision of the integrated circuit 24 within the module may enable additional functionality such as individual addressability and dimming of the LED 16.

In FIGS. 3A to 3C, each of the modules 10 is shown to include only two pairs of module electrodes 18-1A, 18-2A and 18-1B, 18-2B. However, the modules 10 may include more than two pairs. In addition, although the size and shape of the module electrodes are depicted as being the same, differently sized and shaped module electrodes 18 may alternatively be used. For example, the module electrodes 18 may be of two different shapes which tessellate in order to cover substantially the entire exterior surface of the module body 14. In this way, the aggregate area of the module electrodes is maximized, but the probability of short-circuits is kept low because each individual module electrode 16 is relatively small.

It will be appreciated that the integrated circuit 24 of FIG. 3C may be used in a module 10 comprising more than one LED 16 and/or a single pair of module electrodes 18.

Figure 4:
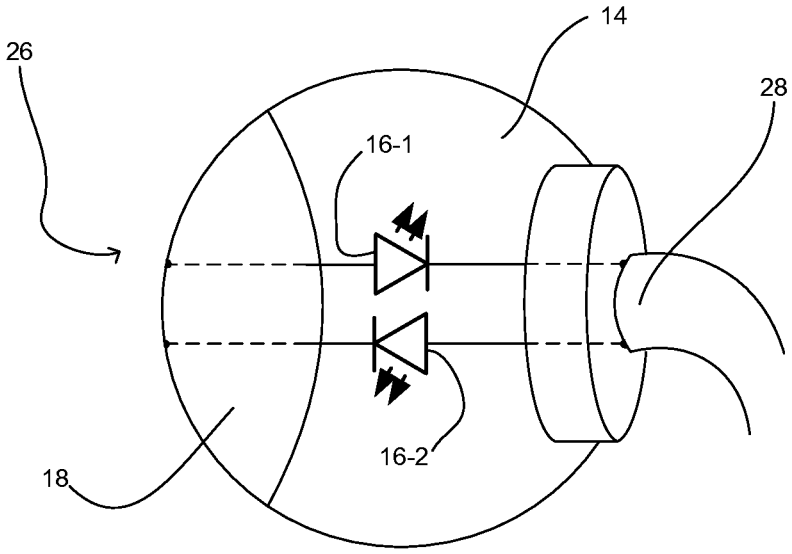
FIG. 4 depicts an example of a terminal module in accordance with the invention.

FIG. 4 depicts an example of another type of module 26 in accordance the invention. The module 26 in FIG. 4 is hereafter referred to as a terminal module.

The terminal module 26 comprises a module body 14, and in this example, two LEDs 16 provided within the body 14. In other examples, the terminal module may 26 comprise zero or plural LEDs 16. The terminal module 26 also comprises at least one module electrode 18. In addition, the terminal module 26 also comprises a driver connector 28 for connecting with a driver circuit (not shown). The driver circuit is operable to provide power to the terminal module 26, via the driver connector 28, at a suitable frequency, voltage, current etc. In this example, the driver connector 28 simply comprises a wire. It will be appreciated, however, that the driver connector 28 may alternatively comprise a socket for receiving a plug connection. The driver connector 28 is in electrical connection with the at least one diode 16. Specifically, in this example, the terminal module 26 comprises two LEDs 16-1, 16-2 and the driver connector 28 is in electrical connection with the anode of a first of the LEDs 16-1 and the cathode of the second of the LEDs 16-2. The anode of the second LED 16-2 and the cathode of the first LED 16-1 are in electrical connection with the module electrode 18.

The terminal module 26 may also contain a receiver for wireless power transfer. This allows for lighting systems without power cables protruding there from. Furthermore, it allows for freedom of placement and/or orientation (in examples, in which multiple wireless power receivers are provided in the lighting system 1) of the lighting system 1.

The terminal module 26 may include one or more additional pairs of surface electrodes (not shown) in addition to a bridge rectifier (not shown) or an integrated circuit (not shown) for routing current correctly to or from the driver connector 28 and through the one or more LEDs 16.

Figure 5:
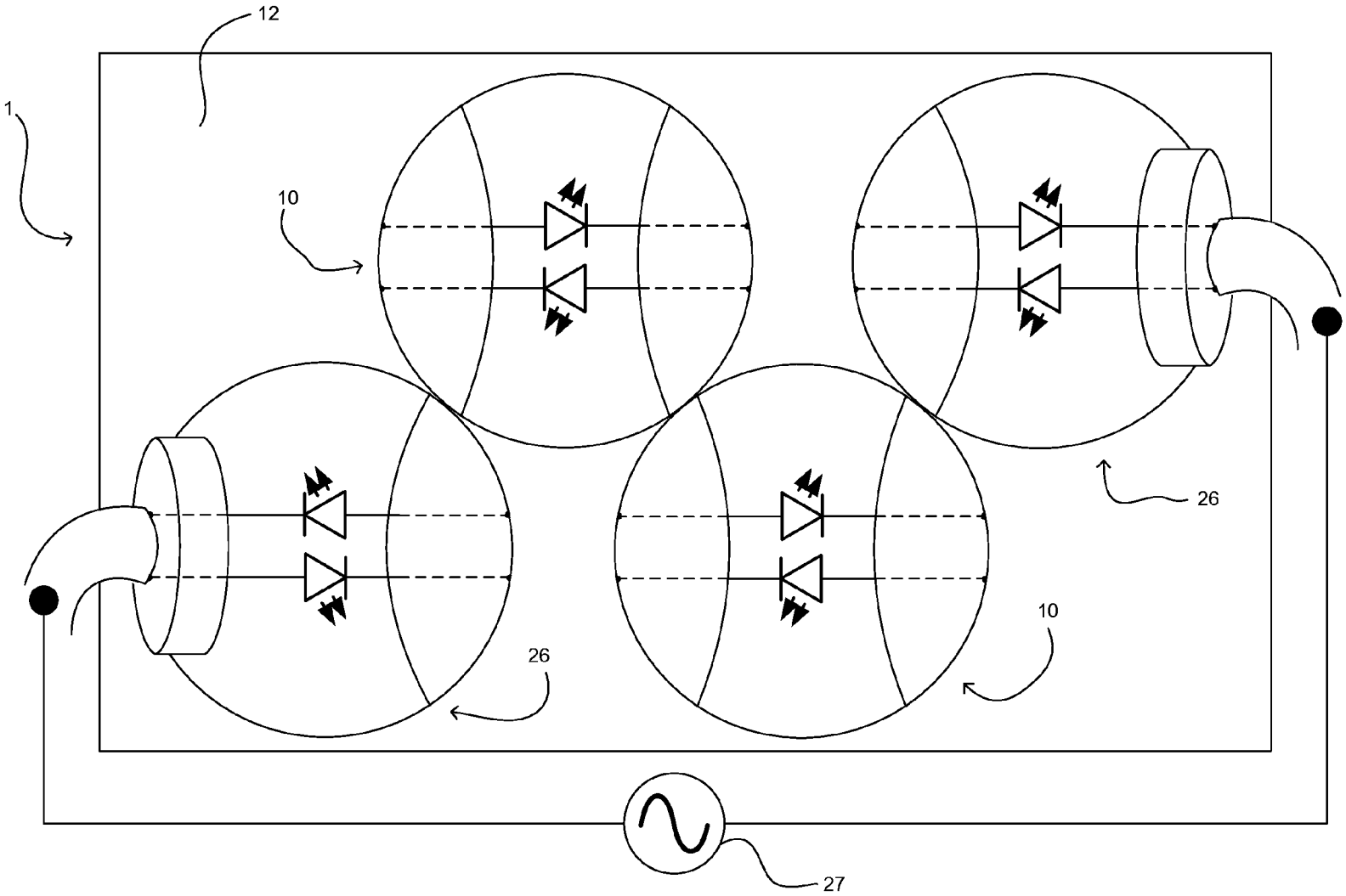
FIG. 5 is a schematic illustrating the operation of embodiments of the invention.

FIG. 5 depicts a string of modules 10 wherein a module electrode 18 of each of the modules 10 at the distal ends of the string are in direct, physical contact with a module electrode 18 of a different terminal module 26.

A lighting system 1 according to the invention may include terminal modules 26 located at opposite ends of the system. The positioning of the terminal modules 26 provides some control over paths that are taken by the electric energy. More specifically, the electric energy will travel via the path that offers the least resistance. As such, it is likely that LED modules provided in a region of the lighting system 1 that is substantially between the two end terminals 26 will be illuminated.

The lighting system 1 may include more than two terminal modules 26 placed at any suitable location within the system. By controlling the flow of current from the driver circuit to one or more pairs of terminal modules 26, lighting effects may be achieved by causing current to flow along different strings of modules 10 throughout the object. In addition, the provision of more than two terminal modules 26 provides robustness by allowing different strings of modules to be used if some strings are not functioning well. In some examples, the terminal modules 26 may be located at the periphery of the system. In other examples one or more terminal modules 26 may be placed in central regions of the system and one or more other terminal modules 26 may be placed at the periphery. For example, a single terminal module 26 may be located at the centre of the system and plural modules may be located around the periphery. In such an example, conductive paths would start at the centre of the system and extend towards the edges.

The driver circuitry (not shown) may be moulded within the system such that only a single wire is required to extend from the system so as to connect the driver circuitry with a power supply 27, such as mains electricity.

The formation of conductive paths through the lighting system 1 is dependent on incidental, direct physical contact between the module electrodes 18 of two neighboring modules 10. This direct, physical contact may sometimes be disrupted. In order to address this, an asymmetrically conducting silver paste may be applied to the module electrodes 18. This paste may contain about 20% silver particles in an, optionally transparent, binding material. When two module electrodes 18 having the paste thereon are in direct, physical contact with one another, a silver contact is formed by a temperature step of 120° C.

Figure 6:
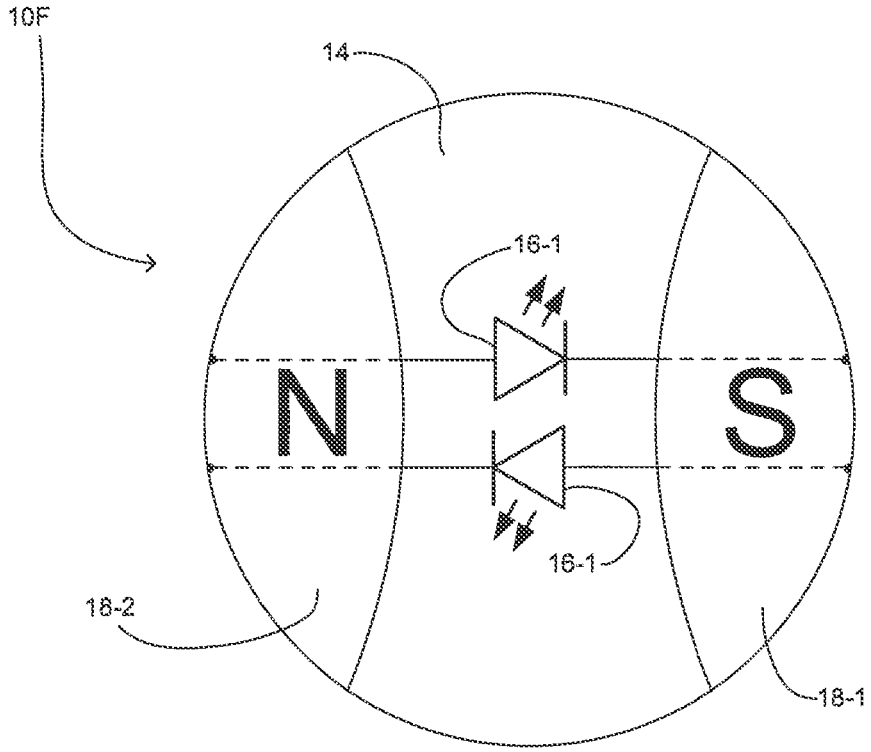
FIG. 6 is an example of an alternative example of an LED module in accordance with the invention.

The integrity of the transfer of electrical energy between two neighboring modules can also be ensured or improved in other ways. FIGS. 6 to 8 illustrate LED modules 10 which may provide improved propagation of electric energy (or electric energy) along one or more strings of modules 10.

FIG. 6 is a module 10F that is substantially the same as shown in FIG. 2A. However, in FIG. 6, the module 10F includes a permanent magnetic dipole. The magnetic dipole is aligned with an axis extending between the two module electrodes 18. The magnetic dipole may be provided by a permanent dipole magnet included within the body 14. The presence of the magnetic dipole aligned with the axis between the two module electrodes 18-1, 18-2 causes neighboring modules to align themselves with one another such that their module electrodes 18 come into physical contact with one another. In addition, when two module electrodes 18 having opposite poles come into direct, physical contact, the magnetic attraction causes a strong physical contact to be formed between the module electrodes 18. The magnetically-induced alignment of the modules also reduces the occurrence of short circuits.

The module 10F of FIG. 6 may alternatively comprise only one LED 16. The magnetic poles may aid the alignment of neighboring modules 10F such that each module in the string is correctly aligned such that the cathode module electrode (i.e. the module electrode that is electrically connected with the cathode of the LED 16) faces the anode module electrode 18 of the neighboring module 10F. Consequently, electric energy is able to flow along a string of modules without being prevented by incorrectly oriented modules.

The use of magnetized modules 10F induces some degree of self-organization or self-orientation of the modules 10F. As such, the magnetization aids the formation of module strings. Consequently, fewer modules 10 may be required in order to reach percolation threshold where electric energy is able to flow along strings of modules.

Magnetized modules 1 OF within a lighting system in accordance with the invention may be aligned by an externally applied magnetic field, applied before or during the moulding process.

Although not illustrated, it will be appreciated that the magnetized modules 10F of FIG. 6 may comprise one or more of a plurality of pairs of module electrodes 18, a bridge rectifier 20 and an integrated circuit 24 as described with reference to FIGS. 3A to 3C.

Figure 7A:
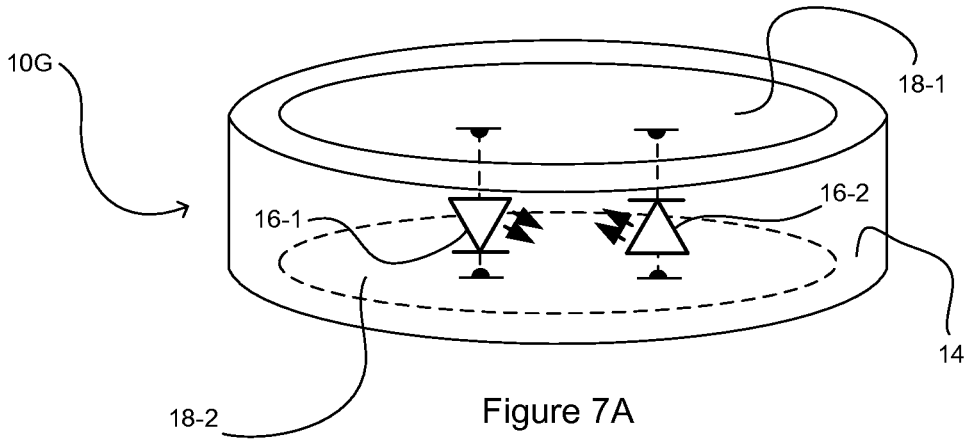
FIGS. 7A to 7C depict an example of another LED module in accordance with the invention.
Figure 7B:
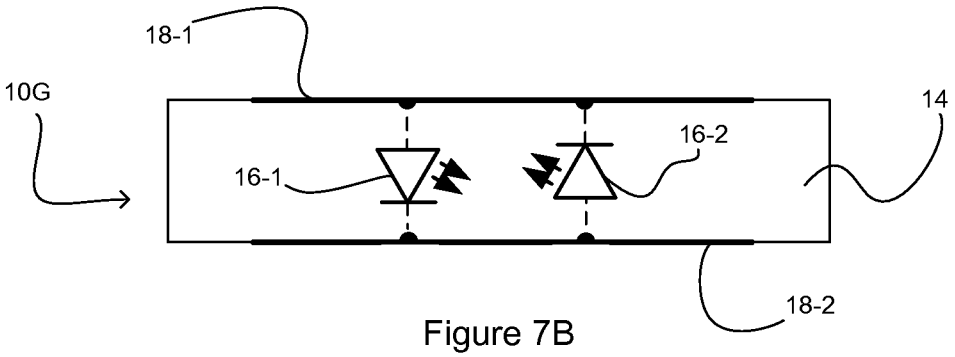
Figure 8A:
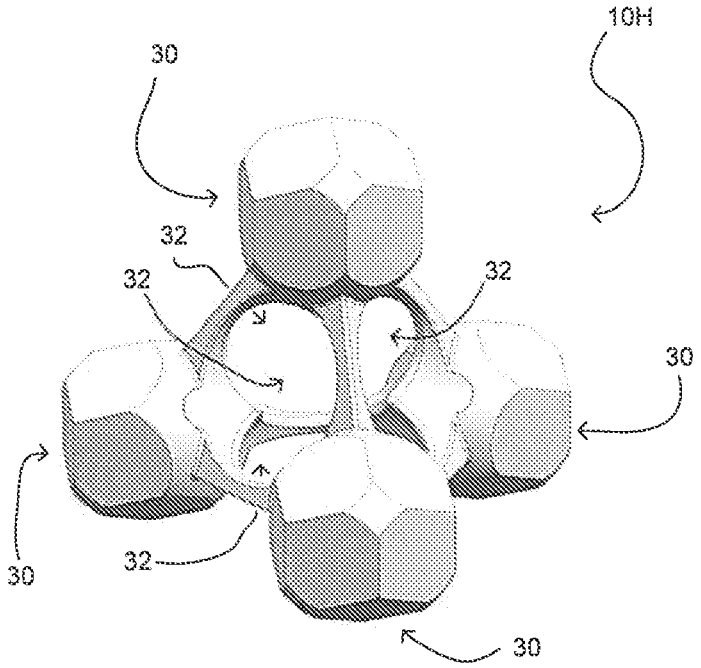
FIGS. 8A and 8B depict yet another LED module in accordance with the invention.
Figure 8B:
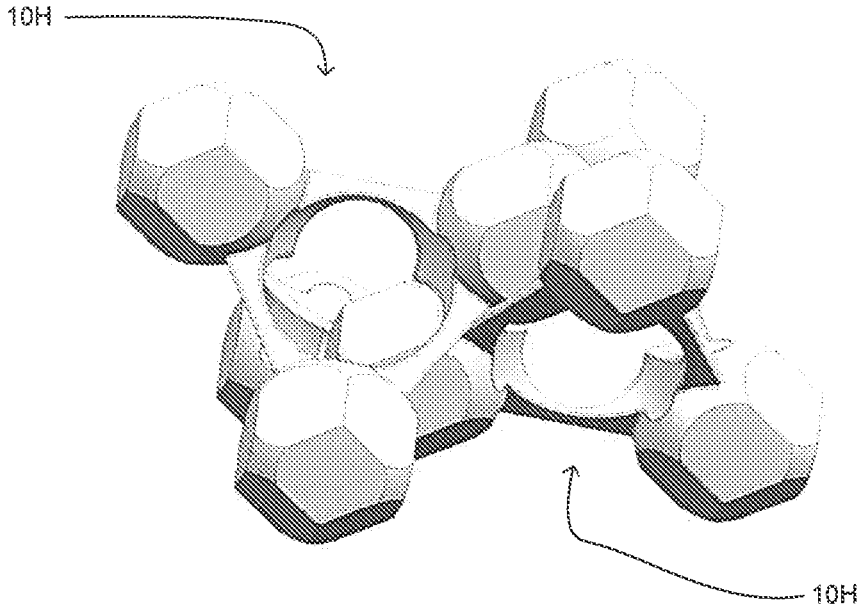

FIGS. 7A and 7B are schematic three dimensional and cross-sectional views of an alternative LED module 10G. This module 10G, and also the module shown in FIG. 8, has a physical shape that is adapted so as to assist the formation of connections between module electrodes of 18 neighboring modules 10G and also for aiding in the avoidance of short circuits.

The modules of FIGS. 7A and 7B include two opposing planar surface electrodes. In this example, the modules 10G are flattened cylinders, wherein the height of the cylinder (i.e. the distance between the planar surfaces) is less than the diameter of the cylinder. The presence of planar surfaces electrodes aids the organized orientation of the modules 10G into tiers of modules as can be seen in FIG. 7C.

The module electrodes 18-1, 18-2 are provided on flat surfaces of the module 10G. The useful flow of electric energy (i.e. electric energy that causes activation of the LEDs 16) will predominantly be in a direction between tiers of modules 10G in a vertical direction (see FIG. 7C), whereas propagation of electric energy in a horizontal direction will predominately be due to short-circuits. By providing terminal modules at the top-and-bottom of the system, the electric energy can be forced to flow mainly in the vertical direction between the tiers along the strings of modules, thereby causing illumination of the LEDs. The self-alignment into tiers may be facilitated by shaking the modules 10G before or during moulding.

Figure 7C:
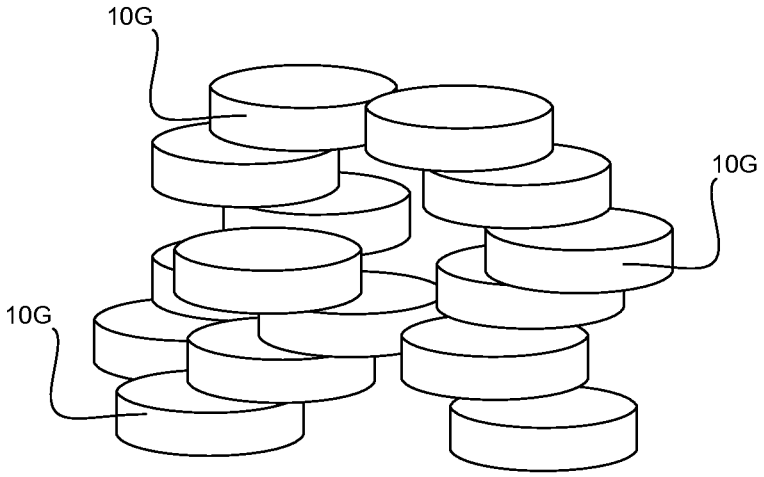

As is depicted in FIG. 7C, two LEDs 16 may be provided in anti-parallel arrangement within the module 10G. Alternatively, one or more LEDs 16 may be provided along with one or more bridge rectifiers or an integrated circuit such as that shown in FIG. 3B. Also, the module 10G may comprise plural pairs of module electrodes 18.

Although in the example of FIG. 7 the modules are disc-shaped, it will be appreciated that the modules may be of other shapes. For example, the modules 1 OF may be cuboidal.

According to other examples, the formation of strings of modules 10 may be facilitated by modules 10 in which one module electrode of a pair is concave and the other is convex. As such, the convex module electrode of a module may sit within the concave module electrodes of a neighboring module. Modules such as these may be more likely to orientate themselves correctly and the physical direct contact between the module electrodes may be more robust.

FIG. 8 is an illustration of a module 10H which includes convex and concave module electrodes. Specifically, the modules 10H are tetrahedrons comprising four protuberances 30 on which module electrodes may be provided and four recesses 32 in which other module electrodes are provided. Any suitable arrangement of LEDs (not shown) may be used.

The shape of the module 10H allows robust interconnection between modules wherein a protuberance of one module is provided in a recess of a neighboring module. This can be seen in FIG. 8B, which shows two modules 10H of a string.

In some examples, the modules may be shaped such that the convex and concave module electrodes interlock semi-permanently (i.e. by push fit or "click fit"). Strings of such modules may be assembled prior to mixing with the insulating material.

Alternatively, self-alignment of the modules 10 may be promoted by using a surface treatment of the modules or module electrodes. For example, a hydrophobic coating may be applied to the modules 10 and the filling material 12 may be water-based. This increases the probability that modules will come into direct physical contact.

In the examples described above, the modules 10 comprise a body 14, the module electrodes 18 being provided on the surface of the body 14. However, some modules may omit the body. As mentioned above, the volume of the module, which may be used in determining the percolation threshold of the composite material, is delimited by location of the module electrodes and the location of the LEDs which are provided within the volume. In such examples, the size (or volume) of the modules may be increased by extending the module electrodes further away from the LEDs of the module. In such embodiments, the module electrodes may comprise wires or surface electrodes of any suitable shape.

In other examples, the size of the modules may be increased by locating a module within a supplementary translucent shell. The shell has internal electrodes which come into physical contact with module electrodes of the module inside the shell. The shell also has external electrodes which are electrically connected with the internal electrodes, and which constitute the module electrodes of the new, enlarged modules.

Terminal modules, although only illustrated as substantially spherical (in FIGS. 4 and 5), may be any suitable shape and may be substantially the same shape as the LED module with which they are being used.

FIG. 9 is a cross-sectional view through another example of an LED module 10I. The module 10I is configured to receive electrical energy from and to transfer electrical energy to neighboring modules 10I using capacitive coupling between the modules 10I. In this example, the module electrodes 18 include a thin layer of insulating material 36 provided thereon. This layer of insulating material 36 means that when the module electrodes 18 of two different modules 10I are in direct physical contact, electric charge is unable to pass from one module electrode 18 to another. Instead, a polarity is formed, with one of the two module electrodes 18 becoming negatively-charged and the other becoming positively-charged. This occurs throughout the string of modules and, as electrons move through the individual modules 10I towards a positively-charged module electrode 18 of a neighboring module, at least one of the at least one light emitting diodes 16-1, 16-2 becomes activated.

The insulating layer 36 may be integrally formed with the body of the module 14. In other words, the conducting part 18 of the module electrodes may be embedded within the body 14, such that a layer of the material of which the body is comprised is provided on the surface of the conducting part 18. In other examples, including modules that do not include a body 14, the insulating layer 36 may simply be a coating of insulating material provided on the surface of the conducting part of the module electrode 18. The insulating layer 36 may comprise, for example, glass, resin, silicone, a plastic such as PMMA, PC or PET, a ceramic or another dielectric material. The layer of insulating material 36 may be, for example between 0.001 mm and 1 mm in thickness.

Figure 10:
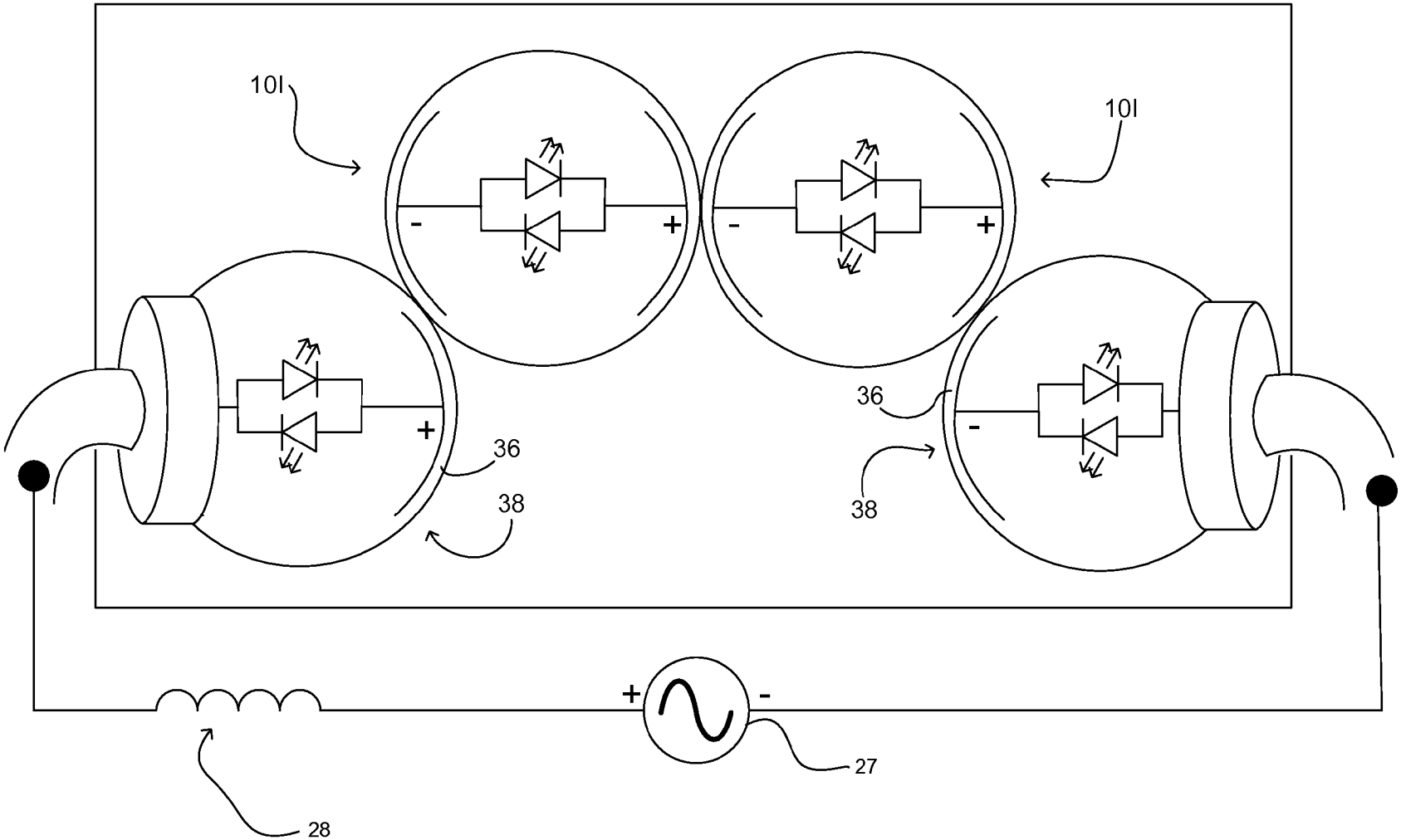
FIG. 10 is a schematic of a string of LED modules as shown in FIG. 9A.

FIG. 10 depicts a string of capacitively-coupled modules 10I and also the polarities formed between the module electrodes 18 of neighboring modules 10I at a particular instance in time. Obviously, as the polarity of the AC power supply changes 27, so too does the polarity of the module electrodes.

In the example in FIG. 10, the power supply 27 is connected in series with an inductor 28. The inductance of the inductor 28 is selected in combination with the frequency of the AC power supply 27, such that the string of modules 10I is driven at a resonant frequency. This increases the efficiency of the capacitively-coupled string of modules.

In FIG. 10, the terminal modules 38, which are attached, or coupled to, the power supply 27 may be substantially the same as those described with reference to FIG. 4, but may include a layer of insulating material 36 provided on the conducting part 18 of the module electrode.

Figure 9A:
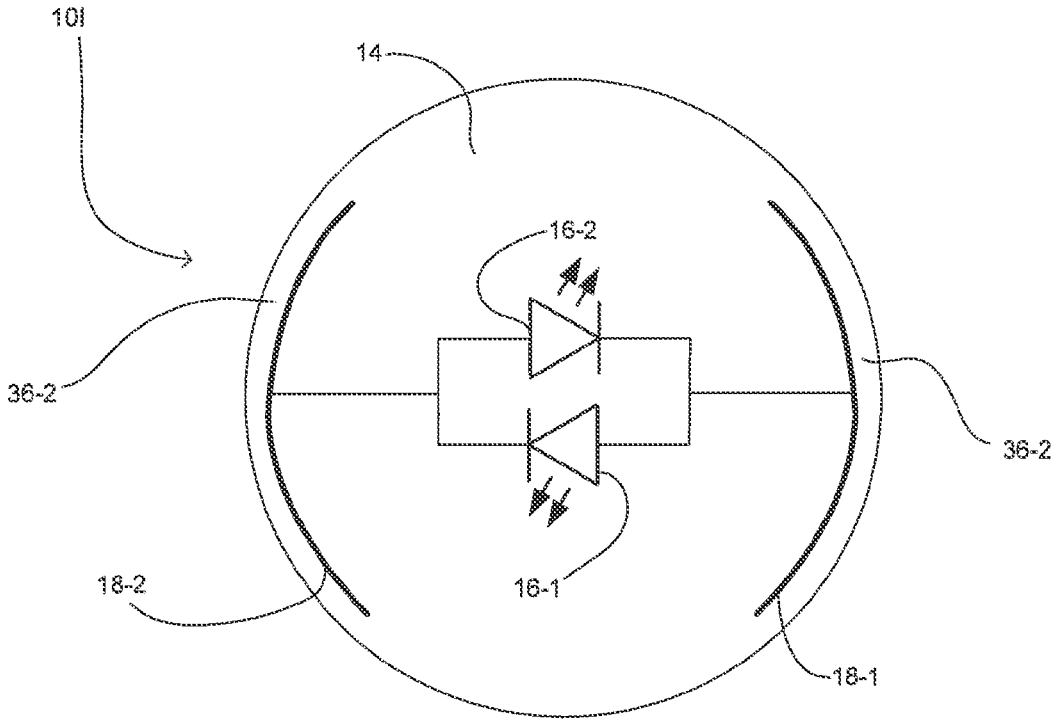
FIGS. 9A and 9B illustrate other LED modules in accordance with the invention.
Figure 9B:
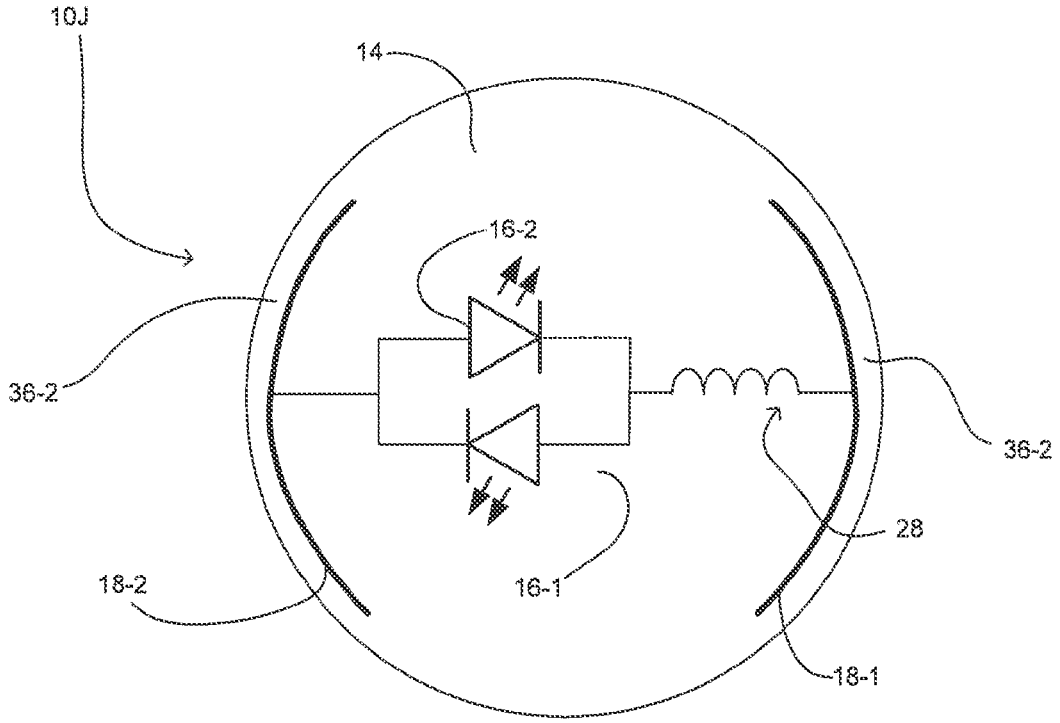

FIG. 9B shows an alternative example of the capacitively-coupled module 10I of FIG. 9A. In this example, the module 10J includes the inductor 28 for tuning the resonant frequency of the module 10J to the frequency of the power supply 27.

Although not explicitly shown in the Figures, it will be appreciated that the capacitively-coupled modules 10I, 10J (i.e. those that comprise module electrodes including the layer of insulating material 36) may include some of the features of modules described with reference to FIGS. 2B, 3A, 3B, 6, 7A-7C, and 8A-8B. As such, the capacitively-coupled modules may include planar module electrodes, magnetized module electrodes, concave-convex corresponding module electrodes, bridge rectifiers, an integrated circuit, and plural pairs of module electrodes. Also, the terminal modules 38 may be adapted for wireless receipt of electrical power from the power supply 27. In some examples, any of the modules described with reference to FIGS. 1 to 8 may be converted for capacitive-coupling by locating them inside an additional shell in which the conducting parts of the module electrodes of the shell are in electrical contact with the module electrodes 18 of the module, but which are covered in a layer of insulating material.

It will be appreciated that the term "comprising" does not exclude other surface electrodes or steps and that the indefinite article "a" or "an" does not exclude a plurality. A single processor may fulfill the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived there from.

Other modifications and variations falling within the scope of the claims hereinafter will be evident to those skilled in the art.

The invention claimed is:

1. A lighting system having a translucent portion comprising a composite material, the composite material comprising a plurality of discrete light emitting diode modules embedded in a translucent insulating filler material;

wherein each light emitting diode module comprises a light emitting diode and at least a first module electrode and a second module electrode, the first module electrode being in electrical connection with a cathode of the light emitting diode and the second module electrode being in electrical connection with an anode of the light emitting diode;

wherein the number of discrete light emitting modules per unit volume of the composite material is above a percolation threshold so that the whole volume of the composite material is spanned with a network of randomly-formed electrically conductive paths, each electrically conductive path comprising a string of neighboring light emitting diode modules; and wherein at least one of the first and second module electrodes of each of the light emitting diode modules in the string is in direct physical contact with at least one of the first and second module electrode of a neighboring light emitting diode module in the string such that, when a voltage is applied across the string, electric current flows in each light emitting diode module in the string thereby activating the light emitting diode of each light emitting diode module in the string.

2. The lighting system of claim 1, wherein the first and second module electrodes of each light emitting diode module define a volume there between, the light emitting diode of the light emitting diode module being located within the volume, wherein the first and second module electrodes are positioned on opposing sides of the volume such that an axis extending between the first and second module electrodes passes through a central point of the volume.

3. The lighting system of claim 1, wherein each light emitting diode module comprises a body, at least a portion of which is translucent, the light emitting diode being encased within the translucent portion of the body such that light emitted by the light emitting diode of the light emitting diode module is detectable outside the body and, wherein each of the first and second module electrodes of each light emitting diode module comprises a surface electrode provided on an exterior surface of the body.

4. The lighting system of claim 3, wherein each light emitting diode module is configured such that the light emitting diode is activated when a voltage difference is provided across the first and second module electrodes of the light emitting diode module, regardless of the polarity of the voltage.

5. The lighting system of claim 1, wherein each light emitting diode module further comprises:

a second light emitting diode, wherein the cathode of the light emitting diode and the anode of the second light emitting diode are electrically connected with the first module electrode, and wherein the cathode of the second light emitting diode and the anode of the light emitting diode are electrically connected with the second module electrode.

6. The lighting system of claim 1, wherein each light emitting diode module comprises:

a bridge rectifier circuit electrically connected with the light emitting diode such that the light emitting diode is activated regardless of the polarity of the voltage difference provided across the first and second module electrodes; or an integrated circuit configured to determine the polarity of the voltage difference provided across the first and second module electrodes and to route current from the module electrode having the higher voltage to the cathode of the light emitting diode.

7. The lighting system of claim 6, wherein each of the light emitting diode modules comprises:

a third module electrode and a fourth module electrode, the third module electrode being in electrical connection with the cathode of the light emitting diode and the fourth module electrode being in electrical connection with the anode of the light emitting diode, or the third module electrode being in electrical connection with the cathode of another light emitting diode and the fourth module electrode being in electrical connection with the anode of the another light emitting diode.

8. The lighting system of claim 1, wherein the first and second module electrodes of each light emitting diode module comprise planar surface electrodes.

9. The lighting system of claim 1, wherein one of the first and second module electrodes of each light emitting diode module is concavely-shaped and wherein the other of the first and second module electrode of each light emitting diode module is convexly-shaped.

10. The lighting system of claim 1, wherein each light emitting diode module comprises a magnetic dipole that is substantially aligned with an axis that extends between the first and second module electrodes.

11. A lighting system of claim 1, comprising at least two terminal modules, the terminal modules being in direct physical contact with the light emitting diode modules at opposite ends of the string, the terminal modules comprising a module electrode, which is in physical contact with at least one of the first and second module electrodes of the light emitting diode module, and a power transfer element for receiving power from, or transferring power to, a power source.

12. The lighting system of claim 11, wherein the first and second module electrodes of each light emitting diode module is covered by an insulating layer, such that the light emitting diode modules that are in direct, physical contact capacitively-couple with one another when a voltage is applied across the string.

* * * * *